US005120236A

United States Patent [19]

Gilbert

[11] Patent Number: 5,120,236

[45] Date of Patent: Jun. 9, 1992

[54] APPLIANCE LOCKING DEVICE

[76] Inventor: Gene Gilbert, 34746 Bernard Dr., Tracy, Calif. 95376

[21] Appl. No.: 715,613

[22] Filed: Jun. 14, 1991

[51] Int. Cl.[5] ..... H01R 13/44; H01R 29/00

[52] U.S. Cl. ..... 439/133; 439/188; 200/43.08; 200/317

[58] Field of Search ..... 439/133, 188, 304, 366, 439/488–490, 502; 200/43.06, 43.08, 317

[56] References Cited

U.S. PATENT DOCUMENTS 2,856,474 10/1958 Norris ..... 200/43.08

3,119,046 1/1964 Usher ..... 200/317

5,026,300 6/1991 Varner ..... 439/371

*Primary Examiner*—Paula A. Bradley

*Attorney, Agent, or Firm*—Leon Gilden

[57] ABSTRACT

A device particularly for use to electrically isolated appliances, particularly a television, from unauthorized use. The device includes a first and second respective indicator light mounted about a two-position lock switch, wherein the lock switch utilizes a key to effect positioning of the lock switch to selectively actuate the first or second indicator light to disengage or engage electrically the associated television.

3 Claims, 3 Drawing Sheets

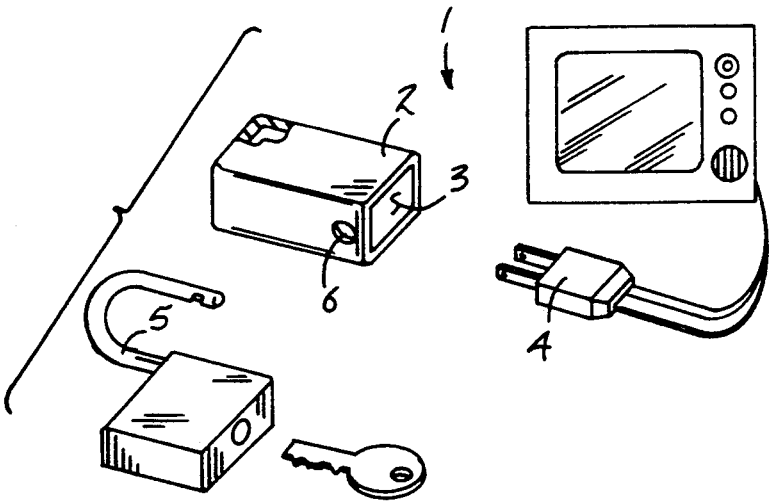
Fig 1
PRIOR ART
Fig 2
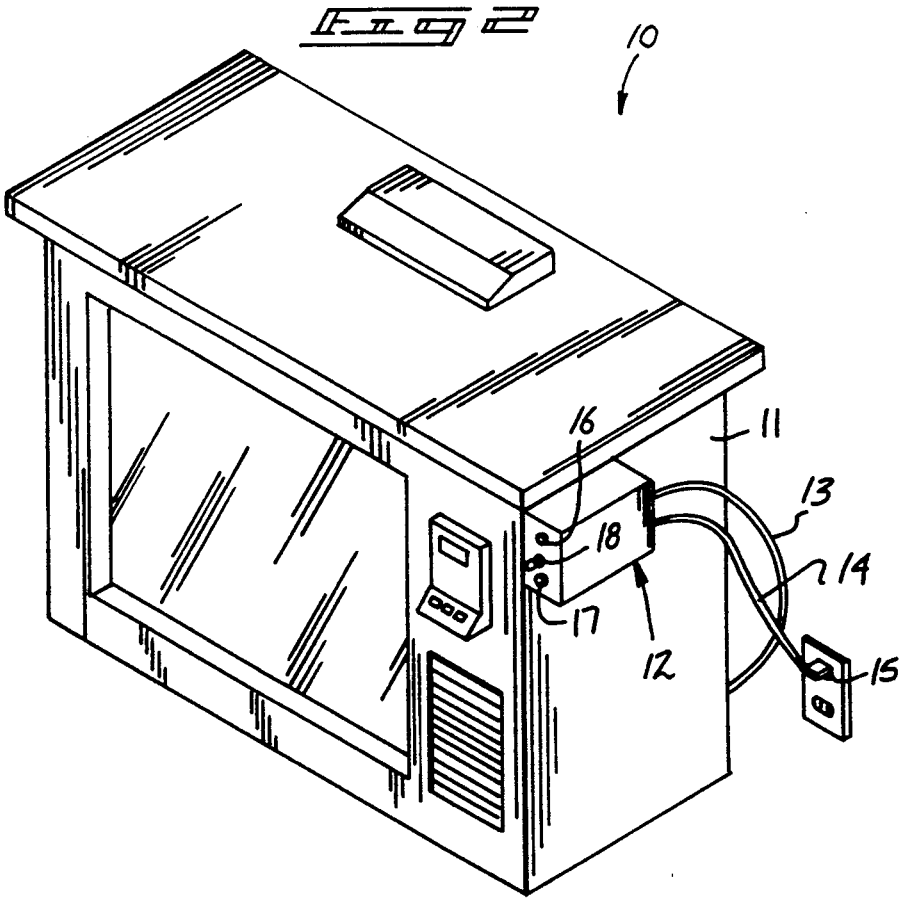

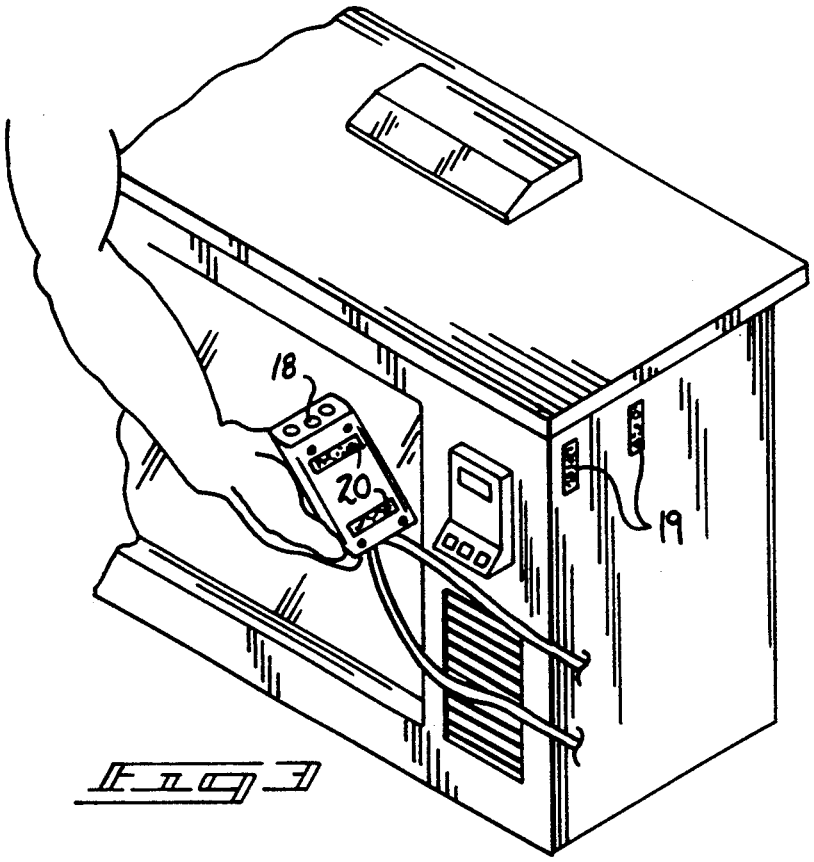
Fig 3
Fig 4
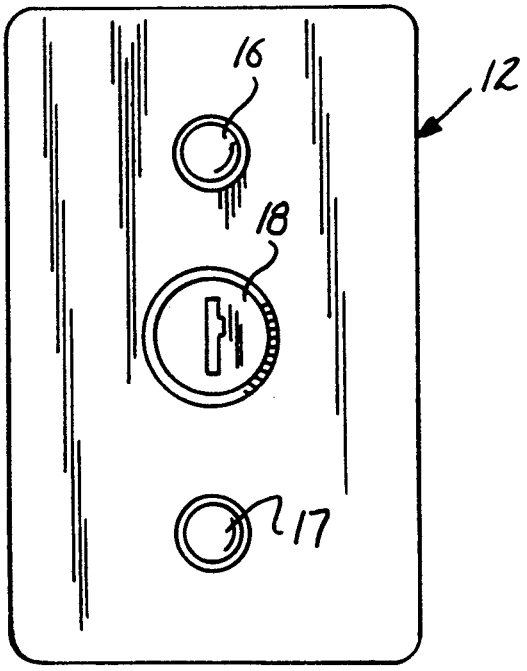

APPLIANCE LOCKING DEVICE

BACKGROUND OF THE INVENTION

1. Field of the Invention

The field of invention relates to apparatus for controlling access to various electrical appliances, such as televisions, electrical tools, and the like. More specifically, the instant invention sets forth an organization to electrically isolate an appliance relative to an electrical power source to prevent unauthorized use thereof.

2. Description of the Prior Art

Various devices have been utilized in the prior art to prevent access to electrical appliances Examples of such may be found in U.S. Pat. No. 4,653,824 to Jason, et al. wherein a lockout device mechanically contains the plug end of a power supply cord within a housing.

U.S. Pat. No. 4,484,185 to Graves sets forth a safety plug which includes an over-current protection device and a plug adaptor to prevent a small child and the like from removing the plug from an adaptor organization relative to an associated electrical outlet.

U.S. Pat. No. 3,543,544 to Efston sets forth a locking device for use with an electrical plug to provide a locking of the electrical plug relative to the device and permit selective removal of the plug therefrom.

U.S. Pat. No. 2,654,073 to Katz, as well as the U.S. Pat. No. 2,955,272 to Gallardo provide housing structure to secure an electrical plug member within an associated housing.

As such, it may be appreciated that there continues to be a need for a new and improved appliance locking device which permits the selective switching of electrical power with relationship to a power supply and a plug component of an electrical appliance and in this respect, the present invention substantially fulfills this need.

SUMMARY OF THE INVENTION

In view of the foregoing disadvantages inherent in the known types of electrical locking devices now present in the prior art, the present invention provides an appliance locking device wherein the same provides selective electrical switching through a tumbler key lock arrangement to effect switching of electrical power selectively to an associated appliance. As such, the general purpose of the present invention, which will be described subsequently in greater detail, is to provide a new and improved appliance locking device which has all the advantages of the prior art electrical switching and locking devices and none of the disadvantages.

To attain this, the present invention provides a device for use to electrically isolated appliances, particularly a television, from unauthorized use. The device includes a first and second respective indicator light mounted about a two-position lock switch, wherein the lock switch utilizes a key to effect positioning of the lock switch to selectively actuate the first or second indicator light to disengage or engage electrically the associated television.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved appliance locking device which has all the advantages of the prior art electrical switching and locking devices and none of the disadvantages.

It is another object of the present invention to provide a new and improved appliance locking device which may be easily and efficiently manufactured and marketed.

It is a further object of the present invention to provide a new and improved appliance locking device which is of a durable and reliable construction.

An even further object of the present invention is to provide a new and improved appliance locking device which is susceptible of a low cost of manufacture with regard to both materials and labor, and which accordingly is then susceptible of low prices of sale to the consuming public, thereby making such appliance locking devices economically available to the buying public.

Still yet another object of the present invention is to provide a new and improved appliance locking device which provides in the apparatuses and methods of the prior art some of the advantages thereof, while simultaneously overcoming some of the disadvantages normally associated therewith.

Still another object of the present invention is to provide a new and improved appliance locking device wherein the same permits selective securement to an associated housing of an appliance such as a television and selective switching to direct electrical current to the associated appliance from a respective electrical outlet source.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art appliance lock organization.

FIG. 2 is an isometric illustration of the instant invention in association with an electrical appliance.

FIG. 3 is an isometric illustration of the instant invention and its mounting to the electrical appliance.

FIG. 4 is an orthographic frontal view, taken in elevation, of the housing utilized by the instant invention.

DESCRIPTION OF THE PREFERRED EMBODIMENT

Figure 5:
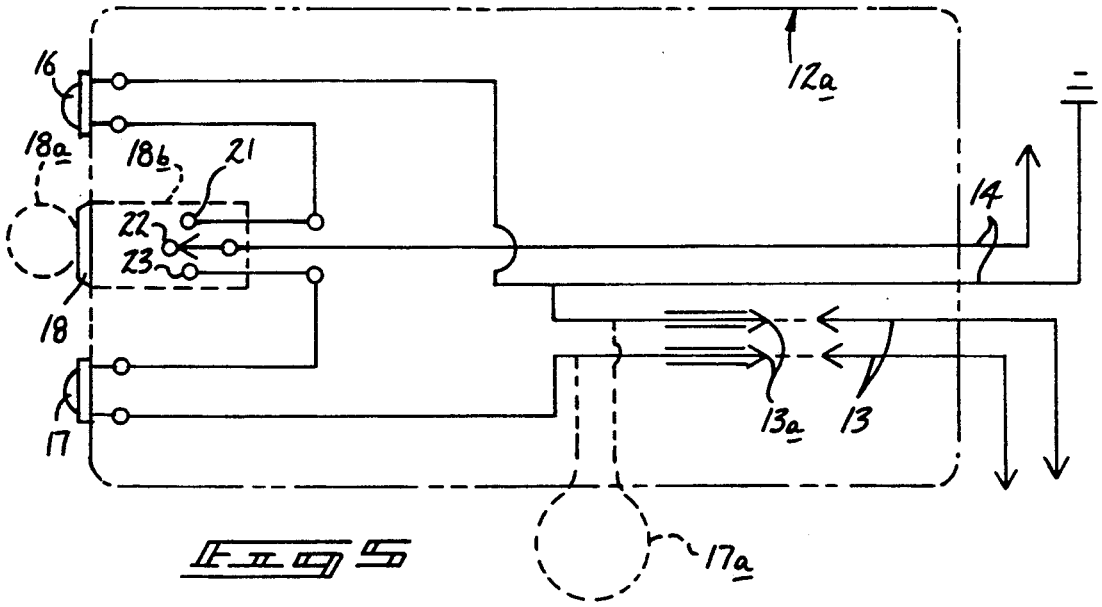
FIG. 5 is an electrical schematic illustration of the circuitry utilized by the instant invention.

With reference now to the drawings, and in particular to FIGS. 1 to 6 thereof, a new and improved appliance locking device embodying the principles and concepts of the present invention and generally designated by the reference numeral 10 will be described.

FIG. 1 illustrates a prior art locking device 1, wherein a housing 2 includes a cavity 3 to contain an electrical plug 4 therewithin. Aperture 6 receives a lock member 5 therethrough to prevent removal of the plug member 4 from the cavity 3.

Figure 6:
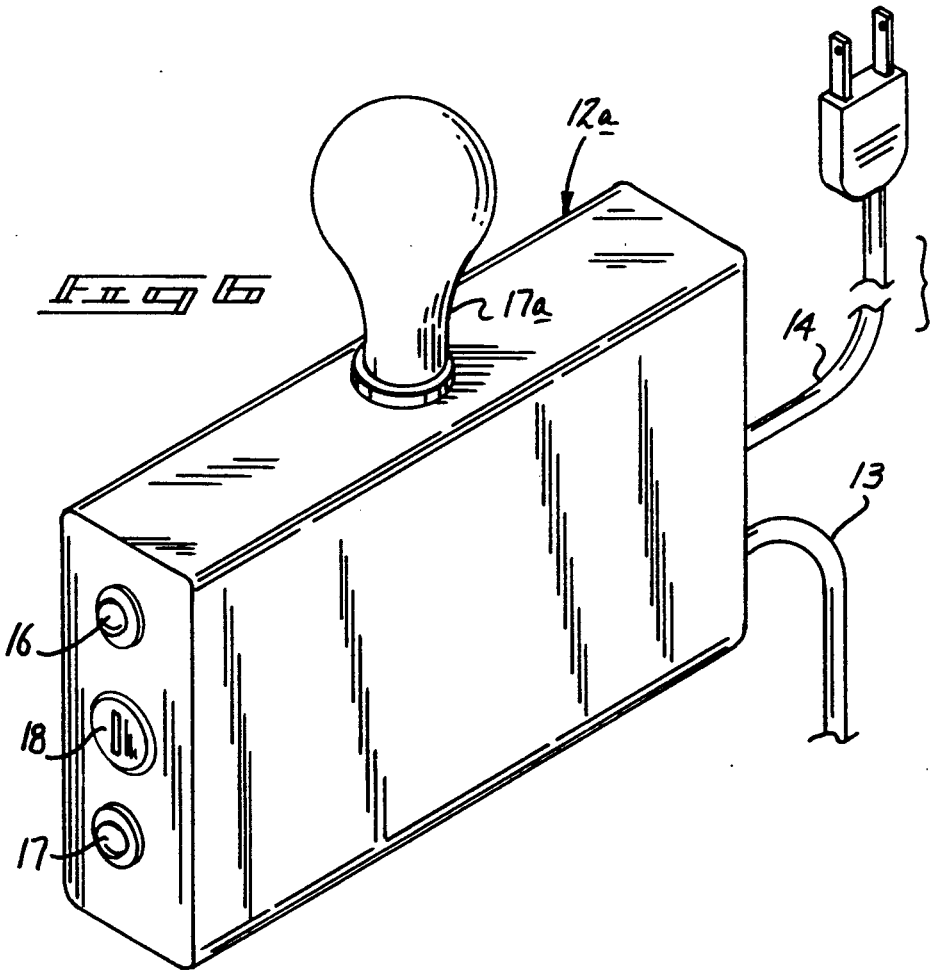
FIG. 6 is a modification of the instant invention utilizing a secondary illumination source for use with an electrical appliance such as in FIG. 2.

More specifically, the appliance locking device 10 of the instant invention essentially comprises a television assembly, including a side wall 11, with a support housing 12 selectively mounted to the side wall 11, as illustrated. A television power cord 13 is contained within the support housing 12 for use in a wired organization, or may alternatively be plugged in and locked within the housing 12, with a supply power cord 14 directed from the housing 12 into an associated electrical power outlet 15. A respective first and second indicator light 16 and 17 respectively are mounted on a forward wall of the housing 11, with a three-position locking switch 18 positioned medially of the first and second indicator light. The first indicator light may be of a first coloration, with the second indicator light of a second coloration such as red and green respectively for indication of selective electrical association of the television power cord 13 to the supply cord 14 through the switch 18. Upon such electrical association, the second indicator light 17 is eliminated, with alternative electrical disengagement of the television power cord 13 from the supply cord 14 and effects illumination of the first indicator light 16 of the first coloration. A conventional key 18*a* and tumbler organization 18*b* are utilized to prevent inadvertent and unauthorized access use of the television unless prior electrical association of the television power cord and supply power cords 13 and 14 are electrically associated through the switch. A first plurality of hook and loop support strips 19 are mounted to the television side wall 11 defined by a predetermined spacing, with a second plurality of hook and loop support strips 20 mounted to a side wall of the housing 12 to permit securement of the housing to the side wall, as illustrated in FIG. 2. Such convenience of mounting permits removal of the organization or association thereof with the respective appliance, in a manner as illustrated in FIG. 2. FIG. 5 illustrates the use of a plug receptacle 13*a* within the housing 11 may be provided to selectively and electrically secure the associated plug portion of an television power cord 13 to the circuitry within the housing 11. A first position 21 of the switch 18 directs electrical association to the first indicator light, wherein a second position 23 of the switch 18 provides electrical association and illumination of the second indicator light. An intermediate position 22 is in electrical association with a neutral power line from the supply power cord 14. FIG. 6 illustrates the use of a modification of the instant invention, with a modified housing 12*a* of a secondary illumination bulb 17*a* in electrical association with the second indicator light to provide a background light for minimizing eye strain in viewing of the associated television, wherein the illumination light or bulb 17*a* is illuminated upon positioning of the switch 18 into the second position for simultaneous illumination of the second indicator light 17 and the secondary illumination bulb 17*a*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An appliance locking device in combination with an associated appliance, wherein the appliance includes a side wall, the side wall includes a first mounting means, and wherein the locking device comprises, a support housing, the support housing including second mounting means cooperating with the first mounting means for selective securement of the second mounting means with the first mounting means, and the appliance including a first power cord, the first power cord mounted within the support housing, and the support housing including a second power cord directed from the support housing for electrical association with an electrical power outlet, and switching means to effect selective switching from the second power cord to the first power cord to permit selective actuation of the appliance, and wherein the first mounting means includes at least one hook and loop fastener member, and a second mounting means includes a second hook and loop fastener member to permit selective securement of the support housing to the side wall, and wherein the first power cord and second power cord are in electrical communication with a switch member, the switch member including electrical association with the first indicator light and a second indicator light, the switch including a first position, a second position, and an intermediate position, wherein the intermediate position provides electrical power to the first and second position, and the second power cord in electrical communication with the second indicator light when the switch is in the second position, and the second power cord electrically disassociated from the first power cord when the switch is in the first position.

2. An locking device as set forth in claim 1 further including a secondary illumination bulb mounted to a support housing side wall, wherein a secondary illumination bulb is in electrical association with the second indicator light for simultaneous illumination of the secondary illumination bulb and the second indicator light when the switch is in the second position.

3. An locking device as set forth in claim 2 wherein the switch includes a tumbler and key to effect selective actuation of the tumbler for positioning of the tumbler to the first, second, or intermediate position.

* * * * *